United States Patent [19]

Canalizo et al.

[11] Patent Number: 4,489,743

[45] Date of Patent: Dec. 25, 1984

[54] DIFFERENTIAL GAS LIFT VALVE

[75] Inventors: Carlos R. Canalizo, Dallas; Ernest P. Fisher, Jr., Carrollton, both of Tex.

[73] Assignee: Otis Engineering Corporation, Dallas, Tex.

[21] Appl. No.: 403,285

[22] Filed: Jul. 29, 1982

[51] Int. Cl.[3] ..... F04F 1/08

[52] U.S. Cl. ..... 137/155; 137/498; 417/115

[58] Field of Search ..... 137/155, 498, 504; 417/115, 116, 117

[56] References Cited

U.S. PATENT DOCUMENTS

| | | | |
|---|---|---|---|
| 2,348,564 | 5/1944 | Otis | 417/117 |
| 2,588,715 | 3/1952 | Garrett | 137/155 |
| 2,601,654 | 6/1952 | Wright | 137/498 X |
| 2,668,554 | 2/1954 | Seyffert | 137/155 |
| 3,523,744 | 8/1970 | Holladay | 417/115 |
| 3,552,490 | 1/1971 | Dollison | 137/498 X |
| 3,888,273 | 6/1975 | Douglas | 137/155 |

*Primary Examiner*—Martin P. Schwadron
*Assistant Examiner*—Stephen M. Hepperle
*Attorney, Agent, or Firm*—Albert W. Carroll

[57] ABSTRACT

A gas lift valve device of the differentially operated type, having a straight, non-tortuous flow passage therethrough, with a hollow valve stem providing a portion of such passage, said device having a floating seat which automatically moves to valve engaging position to check backflow, the area of said seat being larger than the area of a piston on said stem and arranged so that the valve will close at a first predetermined differential pressure and will open at a second predetermined differential pressure which is lower than the first.

10 Claims, 9 Drawing Figures

DIFFERENTIAL GAS LIFT VALVE

BACKGROUND OF THE INVENTION

1. Field of the Invention

This invention relates to well tools and more particularly to gas lift valves used in operating oil wells through practice of gas lift techniques.

2. Description of the Prior Art

Gas lift valves have been used for many years to control the injection of lift gas into a flow conductor from the exterior thereof to aerate a column of liquid therein and aid in lifting it to the surface. While fixed orifices have been used successfully in lifting liquids from well conduits, they waste lift gas. Gas lift valves, on the other hand, are more efficient in that they need not remain open and passing lift gas all the time, but may open only when conditions justify their efficient operation.

One type of valve used in gas lift operations is the differentially operated gas lift valve, commonly called "differential valve". Such valves are normally open but close upon occurrence of a condition where the difference in pressures between the gas lift column and the production column exceeds a predetermined value for which the gas lift valve has been adjusted to close. Because of this characteristic, the pressure of the lift gas is not critical once the well has been unloaded and placed on production. Generally, lift gas is injected into the tubing-casing annulus of a well through a choke which is sized to pass the quantity of lift gas which is needed to produce the desired volume of liquids from the well. In some cases, gas is injected into the tubing and well products are lifted through the annulus.

Listed here are several U.S. patents which disclose a variety of differential gas lift valves. They are: U.S. Pat. No. 2,144,144, U.S. Pat. No. 2,236,864, U.S. Pat. No. 2,256,704, U.S. Pat. No. 2,288,605, U.S. Pat. No. 2,305,250, U.S. Pat. No. 2,314,868, U.S. Pat. No. 2,323,893, U.S. Pat. No. 2,541,807, U.S. Pat. No. 2,588,715.

All of the above listed patents, with the exception of U.S. Pat. No. 2,305,250, have a common basic structural design which is, perhaps, more readily seen and understood when looking at U.S. Pat. No. 2,144,144 which issued to C. S. Crickmer on Jan. 17, 1939. In this patent, and in FIGS. 11 and 12 in particular, the valve member has a piston 41 having its upper end exposed to casing pressure transmitted into the valve housing through lateral ports 46, and has its lower end exposed to tubing pressure transmitted thereto through tubing port 25. A coil spring 44 biases the valve toward open position (shown in FIG. 11). When the pressure in the casing exceeds the pressure in the tubing by a sufficient margin, the difference between these pressures acting across the area of the piston 41 will create sufficient force to move the valve to closed position (shown in FIG. 12), as it overcomes the force of spring 44, and engages seat surface 47 with the seat to stop the flow of lift gas from the casing into the tubing. When the difference between the tubing and casing pressure is reduced sufficiently, the spring 44 will open the valve, i.e., return the valve to its open position (shown in FIG. 11). It is readily seen that the piston areas exposed to the tubing pressure and the casing pressure are equal. Since these areas are equal, the valve both opens and closes at substantially the same pressure. Understandably, the valve may quickly cycle between open and closed positions several times before assuming one position or the other. This is not desirable. It wastes gas and causes unnecessary wear and tear on the mechanism.

The gas lift valves disclosed in the other patents in this group also have valve means with pistons having equal areas exposed to tubing and casing pressures.

U.S. Pat. No. 2,256,704 which issued on Sept. 23, 1941 to C. S. Crickmer, et al., discloses a gas lift valve which is similar to those just discussed. In operation, this valve is in the position shown in FIG. 2 of the patent. Lift gas from the casing enters side ports 37, flows upwardly in flutes 36, flows around the upper portion of valve 30 and past the tapered upper end thereof, and from thence through port 27. When the pressure in the tubing decreases, the velocity of the gas passing the upper end of the valve increases, and the valve moves up toward the seat, pinching the flow therebetween. This further increases the velocity. The upper portion 34 of the valve acts as a piston and plunges into port 27 until it seats as shown in FIG. 3. When liquid rises sufficiently high in the tubing to create sufficient back pressure acting against the upper end of the valve (which acts like a piston), the valve will move to open position.

U.S. Pat. Nos. 2,288,605; 2,314,868; and 2,323,893 which issued to A. Boynton on July 7, 1942, Mar. 30, 1943, and July 13, 1943, respectively, each show a gas lift valve with a hollow-stemmed valve, but these valves have their opposite ends formed with equal seal surfaces thereon and are adpated to engage in equal cup-shaped seats at either end to stop flow through the hollow stem when the differential pressure across the mechanism creates a force exceeding the force of centering spring means associated with the tubular valve stem.

U.S. Pat. No. 2,305,250 which issued on Dec. 15, 1942 to H. U. Garrett et al., discloses a differential gas lift valve which indeed is operated by the difference between tubing and casing pressures, but its valve member does not always present equal areas to the tubing and casing areas and, therefore, acts differently from the devices of the patents just discussed.

The device of U.S. Pat. No. 2,305,250 has a valve member 21 (see FIGS. 2 and 3) with a conical seat surface 23, 22 on its upper and lower ends and a piston 28 just below the upper end. Spring 30 biases the valve toward open position (shown in FIG. 2). The upper end of the valve member can close upper seat 20 which opens to the casing, or its lower end can close lower seat 14 which opens to the tubing. Lateral ports 31 in the valve housing conduct lift gas from the casing into the housing and to lower seat 14 when the valve is open. The ports 31 have a combined area much smaller than the area of either port 14 or port 20.

When the valve is open and is seated on upper port 20, casing pressure cannot act upon the upper side of piston 28, but acts upon the upper end of the valve through port 20. Port 20 is smaller than port 14, and the piston is larger than port 14. Thus, when the difference between the casing and tubing pressures becomes sufficiently great to unseat the valve from upper seat 20, casing pressure immediately acts upon the greater area of piston 28, causing the valve to move to fully closed position with a "snap action". This imparts positive operation to the gas lift valve and prevents the unwanted cycling mentioned above. It also saves gas and avoids unnecessary wear and tear on the valve mechanism.

It is obvious that when the valve is open, the differential pressure acts upon the area of upper seat 20, and when it is closed, the differential pressure acts upon the larger area of lower seat 14. This difference in port sizes causes the gas lift valve to close at a first differential pressure value and to reopen at a second differential value which is lesser than the first.

The present invention is an improvement over the differential gas lift valves mentioned hereinabove. It is formed with unequal areas across which the differential pressure may act to actuate the valve to open or closed position so that the valve will close at a first differential pressure value and close at a lesser value without cycling and without need of a special piston to provide snap action because the opening and closing differentials are so different. Also, the present invention provides a gas lift valve having a less tortuous flow passage through it in that the flow passage passes straight through the valve. The valve stem is hollow and conducts lift gas to the ball valve closure member attached thereto, the lift gas exiting the stem through lateral ports at the ball and passing around the ball and through the seat. A choke or flow bean is advantageously provided in the hollow valve stem. Further, the present invention provides a gas lift valve having novel means for preventing backflow through it.

There is not found in the known prior art a gas lift valve having a valve stem hollow from end to end which closes at one differential pressure and reopens at a lesser differential pressure and having a straight flow passage therethrough with only a small but streamlined detour around its ball closure. Neither was there found a gas lift valve in the known prior art having a floating valve seat which also acts as a check valve and at the same time provdies a straight unobstructed flow passage therethrough when in open position. In addition, there was not found a gas lift valve having a hollow valve stem in which a flow restrictor is provided.

The present invention overcomes many of the problems associated with differential gas lift valves by providing gas lift valves having a straight-through flow passage, a hollow stem constituting a portion of that straight passage, a flow restrictor in the hollow stem, a floating valve seat which also serves to check against backflow, a closing differential which is higher than its opening differential, and simple construction which is less costly to manufacture.

SUMMARY OF THE INVENTION

The present invention is directed to a gas lift valve for attachment to a well flow conductor and having a body with a flow passage therethrough for conducting lift gas between the exterior of the conductor and the interior thereof, a valve seat in the body surrounding the flow passage, a valve closure in the body engageable with the seat to control fluid flow through the flow passage, a hollow valve stem having one end exposed to upstream pressure and its other end attached to the closure member, lateral port means in the stem adjacent the closure member and means for biasing the closure member toward open position to permit fluid flow through the hollow stem, around the valve closure and through the valve seat. This invention is also directed to such gas lift valves having flow restrictor means in the hollow stem, a floating seat for preventing backflow through the valve, and having means whereby the valves close in response to a first differential pressure and open at a second differential pressure which is lesser than the first.

It is therefore one object of this invention to provide an improved gas lift valve for controlling fluid flow between the interior and the exterior of a flow conductor and which is responsive to the difference between the upstream and the downstream pressures to which it is subjected.

Another object is to provide a gas lift valve of the character described which will close when the differential pressure increases to a predetermined value but will reopen when the differential pressure decreases to a predetermined value which is substantially less than the value at which the valve closes.

Another object is to provide a gas lift valve of the character described having a substantially straight, relatively non-tortuous flow passage therethrough.

Another object is to provide a gas lift valve of the character described having a valve closure with a hollow stem providing a portion of a non-tortuous flow passage therethrough.

A further object is to provide such a gas lift valve having flow restricting means in the valve stem thereof.

Another object is to provide a gas lift valve of the character described having improved means therein for preventing backflow therethrough.

Another object is to provide a gas lift valve of the character described having a floating seat which upon occurrence of backflow will move into engagement with the valve's closure member to preclude further backflow through the device.

Another object of this invention is to provide a gas lift valve of the character described having its inlet provided in the form of narrow slits for precluding entrance of larger particles such as sand or debris into the valve mechanism.

A further object is to provide a gas lift valve of the character described which is attachable to a lock or latch device to be removably installed in a seating receptacle, such as, for instance, a side pocket receptacle or a landing nipple forming a part of a well flow conductor.

Other objects and advantages may become apparent from reading the description which follows and from studying the accompanying drawing wherein:

DESCRIPTION OF THE PREFERRED EMBODIMENTS

Figure 1:
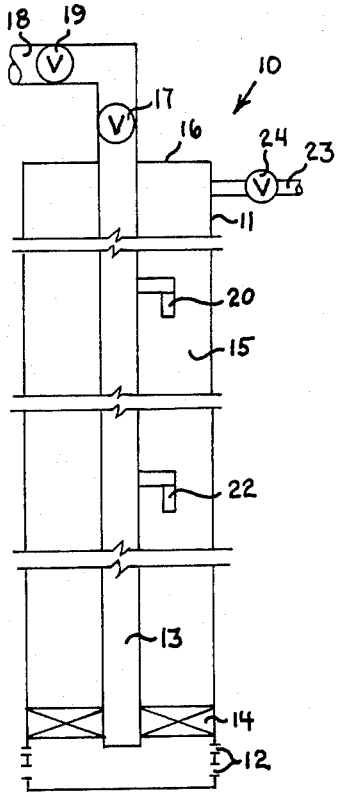
FIG. 1 is a diagrammatical view of a gas lift well having a single string of tubing with a plurality of gas lift valves attached thereto.

The device of this invention is useful in gas lift wells such as the well 10 illustrated diagrammatically in FIG. 1. This well has a casing 11 perforated as at 12 to provide inlets for well products. A well tubing 13 has its lower open end in fluid communication with the casing near the perforations. A well packer 14 closes the tubing-casing annulus 15 just above the perforations while a wellhead 16 closes the annulus 15 at the upper end of the casing. The upper end of the tubing connects to the wellhead 16 and a conventional Christmas tree represented by the valve 17. A flow line 18 containing a wing valve 19 is connected to the Christmas tree to conduct well products to conventional surface equipment (not shown).

The well tubing is equipped with a plurality of gas lift valves, only two of which are shown. These are identified by the reference numerals 20 and 22. These gas lift valves are constructed in accordance with this invention and may be identical to the gas lift valve shown in FIGS. 2–6.

Lift gas is supplied through gas line 23 connected to the casing 11 as shown and includes a valve 24 for controlling flow therethrough. A flow choke (not shown) may be included in line 23 near valve 24, if desired.

All of the gas lift valves described herein and embodying this invention are of the differential type. They are actuated by the difference in pressures of the lift gas and the production fluids which act upon them. These valves are structured such that they close at a predetermined differential pressure and open at a predetermined differential pressure which is considerably lower than the closing differential pressure.

Referring now to FIGS. 3–6, it will be seen that the gas lift valve of this invention is indicated generally by the numeral 25. This valve 25 may be identical to valves 20 and 22 seen in FIG. 2 and function in exactly the same manner and used for the same purpose.

Valve 25 includes a housing or body 28 having a flow passage 29 extending its full length, flow normally taking place therethrough in the direction shown by the arrow 29. The body 28 comprises a main housing member 30 which is internally threaded at its lower end (upstream end) as at 32 for attachment of the plug member 33 while its upper or downstream end is internally threaded as at 34 for attachment of sub 36. This connection is preferably sealed by suitable means such as resilient seal ring 35. Sub 36 is externally threaded at its upper end as at **36*a* for attachment to the lug 37*a* of a conventional lug-type mandrel 37 (shown in dotted lines) made up in the tubing string and providing a passageway (not shown) between the tubing bore and the annulus. When the gas lift valve 25 is attached to the tubing via the lug-type mandrel 37**, gas may be conducted from the annulus to the interior of the tubing when the gas lift valve is open.

Plug member 33 is bored as at 38 from its upper end, but this bore terminates short of its lower end. An inlet for lift gas is preferably provided by narrow cross slots or slits 39 for excluding sizeable particles of debris, et cetera, which may otherwise enter the valve mechanism and cause damage thereto. These slots 39 can be made as wide or as narrow as desired, but they should provide an inlet of adequate flow capacity (at least as great as bore 38).

The main body member 30 has a main bore 40 having a lower portion thereof much enlarged as at 41 providing a downwardly facing shoulder 42. The upper portion of bore 40 is enlarged as at 43 and further enlarged as at 44 providing an inclined shoulder 45, all for purposes to be made clear later.

The sub 36 has a bore 48 which is enlarged as at 49. The outer end of enlarged bore 49 is flared as at 50 to provide a frusto-conical shoulder whose purpose is soon to be explained.

The device 25 is provided with a valve seat having a seat surface which surrounds the flow passage 29 passing through the body 28. This seat may be formed integrally with the sub 36 or could possibly be formed in the main member 30. However, in the form illustrated in the drawing, and particularly FIGS. 3 and 5, such seat surface is provided in a floating valve seat member 60 having a bore 61 therethrough which is enlarged at 62 to provide frusto-conical seat surface 63 adapted to be engaged by a valve member, to be described later, for controlling flow through the bore 61 of the seat member. Enlarged bore 62 of the seat member is flared at its lower end as at 64 to streamline the flow passage and to provide a guide surface for the valve member.

The lower portion of the valve seat member 60 is slidable in bore 45 and has a fairly close fit therewith yet will slide freely therein. Its outer surface 66 is provided with an external annular recess in which is carried a resilient seal ring 67. The upper portion of seat member 60 is reduced in outside diameter as at 65 and is telescoped into enlarged bore 49 of sub 36 as shown where it is freely slidable. The transition between the enlarged and reduced outer surfaces of the seat member 60 provides an external frusto-conical surface 68 in which is formed an external annular recess fitted with a resilient seal ring 69.

Figure 6:
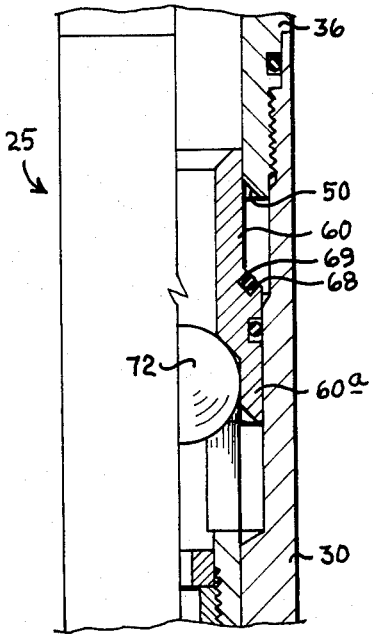
FIG. 6 is a fragmentary view similar to FIG. 3 showing the valve of FIG. 3 in position preventing backflow.
Figure 3:
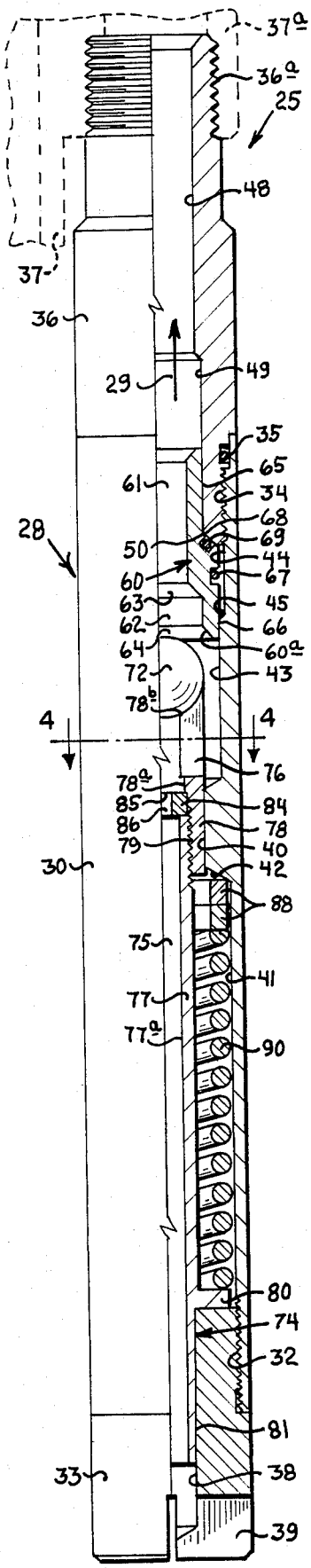
FIG. 3 is a longitudinal view, partly in section and partly in elevation, showing a gas lift valve constructed in accordance with this invention showing the valve in open position.
Figure 5:
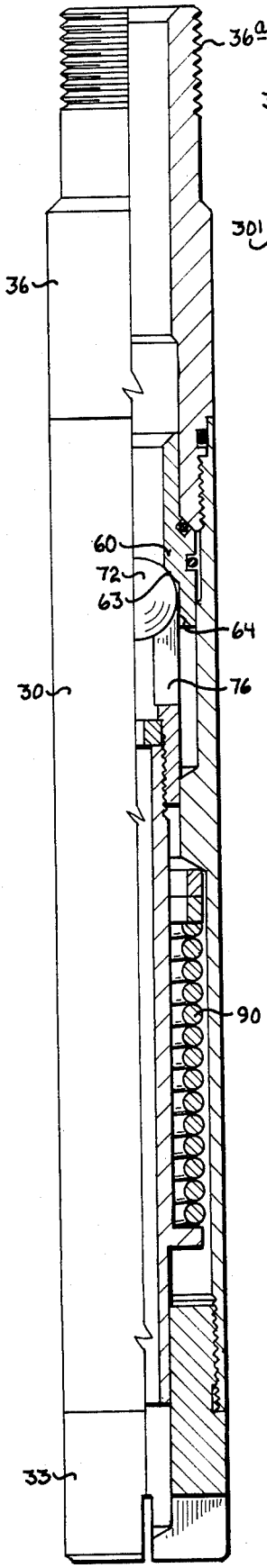
FIG. 5 is a view similar to FIG. 3 showing the device of FIG. 3 with the valve in closed position.

The valve seat member 60 is slidable between an upper position, shown in FIGS. 3 and 5, and a lower position, shown in FIG. 6. When the seat member is in its upper position, its upwardly facing external frusto-conical surface 68 engages downwardly facing frusto-conical surface 50 of sub 36 and seal ring 69 seals therebetween to prevent leakage between the sub 36 and seat member 60.

The seat member 60 is very freely movable to an intermediate position wherein its seal ring 67 reaches upwardly facing inclined shoulder 45 in the main housing member, and is further slidable to its lower position seen in FIG. 6 wherein its seal ring 67 sealingly engages bore 43 in the main housing member, a position which will be more fully explained hereinbelow.

A valve closure member 72 is disposed in the main flow passage 29 of the body and is movable longitudinally relative to the seat member 60 between seated and unseated positions. This valve closure member may be of any suitable shape, but that illustrated in the drawing is in the shape of a ball or sphere 72. This ball is engageable with seat surface 63 to preclude flow through the seat member, and when the ball is thus seated, there is but a small clearance between it and the inner wall of bore 62 of the seat member. The lower portion of the seat member which surrounds bore 62 may be termed a lip and is indicated by the reference numeral 60*a*.

The ball or valve closure 72 has attached thereto a hollow valve stem 74 which is secured to the ball as by silver soldering or other suitable means. The hollow valve stem 74 has a passage 75 extending the full length thereof. Slots 76 are formed in the wall of the valve stem adjacent the ball 72 to enable gas flowing upwardly through the hollow stem to exit just below the ball and bypass it before passing through the valve seat. The flow area through slots 76 should be at least as large and preferably larger than the area of flow passage 75 through the stem.

It is preferable to provide flow restrictor means in the passage of the valve stem 74. If the valve stem is formed in one piece, a restriction may be provided in its bore. For instance, the stem can be bored from its upper end to within a fraction of an inch, say ⅜ to ½ inch, of its lower end. Then this portion can be drilled through with a smaller drill to provide a bore of desired orifice. Alternatively, a screw having an orifice therethrough could be threaded into the stem bore.

In the device illustrated in FIGS. 3 and 5, the valve stem 74 is formed in two pieces: a stem 77 and an adapter 78. The adapter 78 is tubular, having a bore 78*a*, and is internally threaded as at 79. At or near its upper end it is provided with lateral slots 76 as shown. The upper end face 78*b* is shaped to fit the valve closure or ball 72 which is attached thereto as by suitable means such as silver soldering. The stem 77 is threadedly attached as at thread 79 to the lower end of the adapter 78 as shown. The stem 77 is provided with an external flange 80 near its lower end and below flange 80, the stem is reduced in outside diameter as shown at 81 to provide a piston of suitable diameter. If desired, the bore 77*a* of the stem may be restricted by reducing the diameter of the bore, say at one or the other of its ends as previously described, or a screw orifice could be threaded into one of its ends. However, it may be desirable to provide a flow restrictor in the form of replaceable flow bean 84. Bean 84 is captured in sealing engagement between the upper end of stem 77 and downwardly facing shoulder 85 formed in adapter 78 below slots 76. The flow bean is provided with a bore 86 therethrough of suitable orifice. The flow bean may be readily replaced by another bean when such becomes necessary.

A spring 90, preferably a straight helical coil compression spring, is disposed within enlarged bore 41 of the main body member 30 and surrounds the stem 77 with its lower end engaged with the upper side of stem flange 80 and its upper end engaged with downwardly facing shoulder 42 of main body member 30. Thus the spring applies a bias to the valve stem 74 tending to maintain it in its lower position as shown in FIG. 3 with the lower side of its flange engaged with the upper end of plug 33. Thus, the valve stem's longitudinal movement is limited in one direction by its flange 80 engaging the plug and in the other direction by its ball closure 72 engaging the seat 60 as clearly shown in FIG. 5.

The spring 90 can be made of suitable strength to provide the characteristics desired in the valve. The required load of the spring will be dictated principally by the size of piston 81 and the differential pressure at which the valve will be desired to respond. It is preferably formed with a strength somewhat less than maximum with one or more spacers added later if more spring load is needed. Thus, a single spring together with suitable spacers may suffice for many differing installations. Such spacers are shown in the drawing and are indicated by the numeral 88. These spacers, like the flow bean 84, are readily replaced by disassembling at least a portion of the device 25 and reassembling with the desired bean and/or spacer sizes.

It is readily seen that lift gas may enter the device 25 through the inlet slots 39 in the plug, flow upwardly through bore 38, passageway 75 of the valve stem 74 and exit through slots 76, flow around the ball 72 (between the ball 72 and the wall 43 of the body), flow through the bore 61 of valve seat 60, through bore 49, and exit the device through the bore 48 of sub 36. Since the flow passage 29 through the valve conducts lift gas therethrough, such gas is conducted from the tubing-casing annulus into the well tubing through the lug-type mandrel 39.

The flow path through the device is almost perfectly straight, rather than being tortuous as is the case with most such devices. The lift gas only makes but a single jog as it veers momentarily to bypass the ball 72.

The spring 90, as previously stated, tends to maintain the valve in open position (shown in FIG. 3). Back pressure from the tubing acts in conjunction with the load of spring 90 tending to move the valve to open position. The pressure of lift gas in the casing and upstream of the flow restrictor in the valve stem applies a bias to the piston tending to close the valve. This force is equal to the casing pressure (at the valve depth) times the area of the piston.

The piston is a rather close fit in bore 38 of the plug 33, its exterior surface as well as the cylinder, or the wall of plug bore 38, being carefully formed and finished to provide a very close but free sliding fit. At the same time the valve stem has a loose fit in body bore 40 above the spring 90. Thus, the pressure in the spring chamber and exterior of the valve stem will be the same as the pressure existing between the flow restrictor (bean 84) and the valve seat 60, that is, in body bore 43 below the valve seat 60.

Thus, when the valve is open as seen in FIG. 3, the difference between tubing and casing pressures acts across the cross-sectional area of piston 81. When the tubing pressure decreases sufficiently, this differential pressure becomes sufficiently high to overcome the bias of spring 90 and the valve will begin to move toward its closed position, seen in FIG. 5.

When the valve is closed as seen in FIG. 5, the ball 72 is sealingly engaged with seat surface 63 of seat 60 and seals an area the size of or very slightly larger than the cross-sectional area of seat bore 61. Seat bore 61 is somewhat larger than cylinder bore 38 of plug 33. Thus, when the valve is in closed position, the differential pressure acts across an area larger than that across which it acts when the valve is in open position.

In a valve manufactured according to this invention, the area of the piston was 5/16 inch diameter with a cross-sectional area approximately 0.0767 square inch. The seat member 60 had a bore 61 of ⅜" diameter. The valve closure contacted the sharp corner of this bore to seal the passage through the seat. The area sealed by this contact equaling a cross-sectional area approximately 0.1104 square inch.

When such valve is open, the differential pressure acts across the area of piston 81 or the cylinder bore 38 of the plug 33, or 0.0767 square inch. And, when such valve is closed, the differential pressure acts across the area of sealing contact between valve and seat, or an area of 0.1104 square inch, an area about 1.44 times as large as the piston.

For this reason, the valve, after it has been closed by the differential pressure acting across piston 81, will remain closed without cycling until the tubing pressure rises sufficiently to reduce the differential pressure between tubing and casing sufficiently, to enable the tubing pressure and the spring load together to move the valve closure to open position. All of this, of course, is assuming that the casing pressure remains constant, as well it might. And, of course, the above figures hold true regardless of the annulus pressure.

In the example just given, if the casing pressure remains at 600 psi and the spring load is 19 pounds, the tubing pressure at the time the valve begins to move toward closed position will be: $600-(19/0.767)=352$ psi.

Thus, the tubing pressure is 352 psi, the casing pressure is 600 psi, and the differential pressure is $600-352$ or 248 psi. So, the valve in this example will close when the differential pressure rises to 248 psi.

Since both the tubing and the casing pressures act across a common area (the area of the piston 81), the spring governs the differential at which the valve closes. Note that the spring load of 19 pounds acting against the piston area offsets a pressure of (19/0.0767) or 248 psi.

In a similar manner, both tubing and casing pressures act across the sealed area of the seat when the valve is closed. Thus, if the spring (now more compressed) exerts a force of 22 pounds against the seat area of 0.1104 square inches, the valve will open at a differential pressure of $(22/0.1104)=199$ psi. Thus, the tubing pressure at valve opening will be $600-199$ or 401 psi.

Thus, the valve in this example will close at a differential pressure of about 248 psi. It will not cycle, but will remain firmly closed until the differential pressure is reduced to about 199 psi, at which differential pressure it will open.

The valve is normally open and will pass lift gas from the casing into the tubing to aerate the column of fluids therein to aid in lifting them to the surface until the load of such column lightens to the point where the pressure thereof at the valve is so low that it is less than the casing pressure by the differential required to close the valve, or about 248 psi. Subsequently, the well fluids must rise in the tubing to sufficient height to exert a tubing pressure on the valve of about 401 psi to provide a differential of 199 psi and open the valve again.

It should be understood that when the differential pressure reaches sufficient value to cause the valve to begin its movement toward closed position, it must rise even higher to cause the valve to move farther in that direction. This is because such movement increases the compression of the spring, thus increasing the resistance to such valve movement. When the valve has moved about half way to closed position, however, the annular clearance between the ball 72 and the seat lip 60*a* which now surrounds it becomes so reduced that the flow stream is pinched or throttled, thereby causing a drop in pressure therebeyond while pressure begins to build up upstream thereof. With very little delay, the valve then is moved the other half of its travel to fully closed position, further compressing the spring.

Now, please refer again to FIG. 1 of the drawing.

Gas lift valves 20 and 22 are valves of the type described herein, and are considered, for the moment, to be identical to the gas lift valve 25 of FIGS. 2-6. Also, let us suppose that well 10 has just been completed and that both the tubing 13 and the annulus 15 are full of salt water having a pressure gradient of 0.5 psi per foot of depth. For the sake of simplicity, let us further assume that the well will produce nothing but salt water with a gradient of 0.5 pound per foot. If valves 20 and 22 are each adjusted to close when the differential pressure acting across them is 250 pounds per square inch, then, at closing, the spring load acting against the 5/16" piston (area=0.0767 square inch) will be: $250\times0.0767=19.175$ pounds.

The valve will move an additional 0.21 inch (approximately before engaging the valve seat surface 63, and this additional movement increases the compression in the spring. If the rate of spring 90 is 12.5 pounds per inch, its load when the valve is fully closed will be: $19.175+(12.5\times0.21)=21.8$ pounds.

Accordingly, the differential pressure required to open the valve when the spring is applying a load of 21.8 pounds against the valve closure now engaged with the valve seat sealing an area of 0.1104 square inches, will be: $(21.8/0.1104)=197$ psi (approximately).

It is readily seen then that the valves 20 and 22 will each close at a differential pressure of 250 psi and will open at a differential pressure of about 197 psi.

In placing the gas lift valves in well 10, the top valve, valve 20, would be placed at a depth of about $(600-50)/0.5=1100$ feet. This allows 50 psi for tubing surface pressure.

The second valve, valve 22, would be placed below valve 20 by a distance equal to the closing differential of the valve divided by the pressure gradient of 0.5, or $(250/0.5)=500$ feet. Thus the valve 22 would be placed 500 feet below valve 20 or at a depth of $1100+500=1600$ feet. Other like valves would also be placed at 500-foot intervals below one another.

Lift gas in injected into the well's annulus 15 at the surface through a small choke. Gas lift valves 20 and 22 are both open because the differential across them is less than the closing differential of the valves. Valves 17 and 19 are open and salt water issues from the tubing because as lift gas is slowly and carefully applied to the annulus, the salt water U-tubes through the open valves. As the salt water U-tubes from casing to tubing and is produced from the well, the fluid level in the annulus is depressed and casing pressure is gradually increased to 600 psi. When the fluid level in the casing is depressed to 1100 feet, gas enters valve 20 and aerates the fluid column in the tubing and decreases its density. The gradient in the upper 1100 feet of tubing becomes considerably less than 0.5. Salt water continues to U-tube through valve 22 and any other like valves therebelow. The gas in the annulus reaches valve 22, enters it and aerates the fluid in the tubing thereabove. Now, both valves 20 and 22 are injecting gas into the tubing. This so decreases the tubing pressure at valve 20 that it exceeds the valve's set differential pressure, thus it closes. Now, valve 20 continues to inject gas into the tubing to produce more salt water. If there are other gas lift valves below valve 22, they will come into play and will be operated automatically until the working fluid level is reached and the well stabilizes.

After the well has been "kicked off" or "unloaded" and placed on production, the casing pressure can be reduced if desired, and the 250 psi differential of the valves will continue to enable the valves to operate with their 500-foot spacing.

For more detailed instructions in gas lift operation and the spacing of various gas lift valves for the many types of installations, et cetera, a good gas lift manual should be consulted. A good book on gas lift is that entitled "GAS LIFT THEORY AND PRACTICE," by Dr. Kermit E. Brown, Head of the Petroleum Engineering Department at the University of Tulsa, Tulsa, Okla.

Should backflow occur through the gas lift valve, the floating seat member 60 will move toward the valve closure 72 and seat thereon to stop such backflow. This is shown in FIG. 6, which see.

When backflow develops, the valve closure is already in its fully open or lowermost position. Gravity tends to move the valve seat 60 downwards, and this movement is aided by the backflow. When the seal ring 67 on the seat reaches the lower extremity of bore 44 of the main body member 30, it may lodge momentarily at the upper extremity of bore 43, that is, at upwardly facing shoulder 45. However, at this time, the lip 60*a* of the seat will be so close to the ball 72 that the flow therebetween is pinched and the differential pressure acting across the seat quickly increases and promptly moves the seat to its seating position against the ball as seen in FIG. 6.

When flow occurs again in the normal direction, the seat will be returned to its normal position shown in FIGS. 3 and 5.

There is a distinct advantage in having the valve seat 60 slidable in the body so that it will serve not only as a seat but also as a check valve. Most check valves have a tortuous flow passage through or around them. Seat 60 provides a straight-through, non-tortuous, unobstructed flow passage in the form of bore 61.

Figure 7:
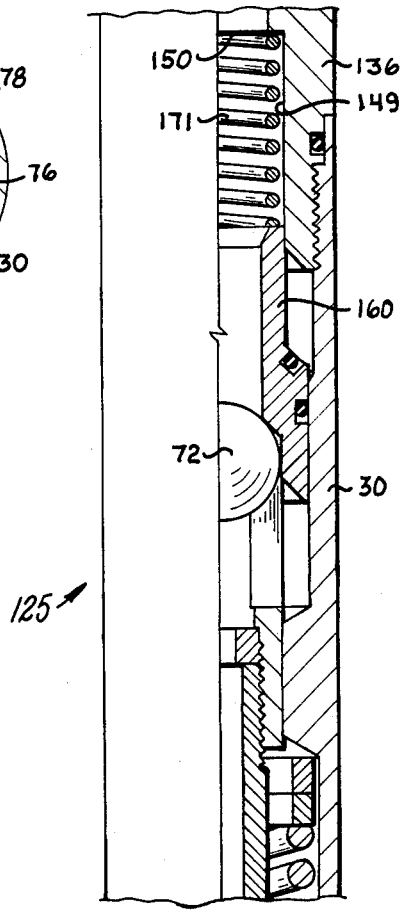
FIG. 7 is a fragmentary view similar to FIG. 6 showing a modified form of gas lift valve having a spring for biasing the floating seat toward backflow preventing position.

When the valve 25 is installed with its upstream end looking downward as is shown in the drawings, gravity applies a constant bias to the valve seat member 60 tending to move it to backflow checking position. If it is desired to increase such bias or to operate the valve in another position, such as an inverted position with its upstream end looking upward, a valve modified as seen in FIG. 7 is to be preferred. In FIG. 7, the modified gas lift valve is indicated generally by the reference numeral 125. Its sub 136 is provided with a bore 149 which may be considerably deeper and a little larger than bore 49 of valve 25, and this bore provides a downwardly facing shoulder 150 which is preferably abrupt. The valve seat member 160 is formed with its upper end face 170 perhaps a little broader than that of its counterpart, the upper end face of seat 60. A seat spring 171 is placed between downwardly facing shoulder 150 and the upper end 170 of the seat member 160 to apply a constant bias to the seat member tending to move it toward the valve closure 72 regardless of which way gravity happens to act thereon.

Gas lift valves of the type described hereinabove will operate automatically after the well has been unloaded and will continue to do so even though the pressure of the lift gas in the annulus may vary over a wide range because these valves operate on the difference between the tubing and annulus pressures rather than being operated by pressure only.

Such valves as described hereinabove will not only operate automatically as just mentioned such as well 10 having valves in a single tubing string, but they are well suited for use in multiple wells where they may be used in a plurality of tubing strings simultaneously. Thus, a well may be equipped with any reasonable number of tubing strings having such gas lift valves therein. The valves will be spaced according to the conditions attendant with each string of tubing, and almost assuredly their spacing will be different in each tubing, causing the valves to be located at scattered levels in the well. Also, the operation of the various valves in the various tubings will surely cause the annulus pressure to vary considerably. Even so, the valves will continue to operate automatically.

Whether unloading a single or a multiple well, it should be done unhurriedly with the lift gas injected into the annulus slowly and preferably through a choke to limit such injection, lest the lift gas be injected too fast, causing the differential pressures to rise suddenly across the valves and close all of them. Should this happen, it may be necessary to bleed gas from the annulus to reduce the annulus pressure, or communicate the annulus with the tubing at the surface to equalize pressures across the valves, or to pressurize the tubing, in order to reduce the differential to where the valves will open before starting the unloading process over again.

Figure 2:
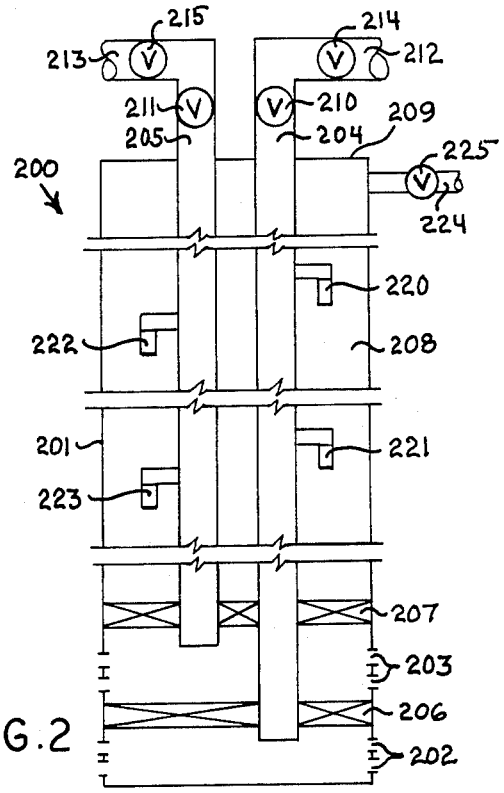
FIG. 2 is a diagrammatical view of a gas lift well having multiple tubing strings therein with a plurality of gas lift valves in each tubing string.
Figure 4:
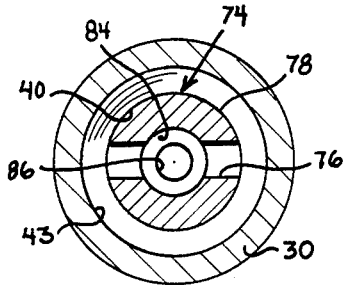
Fig. 4 is a cross-sectional view taken along line 4—4 of FIG. 3.

Referring to FIG. 2, it is seen that a dual well 200 is diagrammatically illustrated. This well is provided with a casing 201 perforated opposite a lower zone as at 202 and opposite an upper zone as at 203. A first tubing string 204 communicates with the lower perforations 202 and the second tubing string 205 communicates with the upper perforations. A single packer 206 seals between the tubing 204 and casing at a location between the two sets of perforations. A dual packer 207 seals between the tubings (204 and 205) and the casing immediately above the upper perforations. The annulus 208 extends to the surface where a wellhead 209 seals the casing around both tubings. A Christmas tree represented by master valves 210 and 211 connects the tubings 204 and 205 to flow lines 212 and 213 having wing valves 214 and 215, respectively.

Tubing string 204 is provided with a plurality of gas lift valves such as valves 220 and 221 as shown and tubing 205 is provided with a plurality of gas lift valves such as valves 222 and 223. These valves are spaced according to good gas lift practices for efficient operation as before explained.

A lift gas line 224 having a valve 225 is connected to the annulus at the surface to supply gas for this gas lift operation.

Well 200 may be unloaded in the same manner as was well 10 of FIG. 1 and either or both tubing strings may be used in doing so, preferably only one. After the well has been unloaded, the valves will operate as they are needed and will do so independently of each other since each valve is operated by the differential pressure across it and each is opened by fluid rising in the tubing. Thus, each valve will pass gas only when such gas is needed. And, these valves will continue to operate automatically in spite of excursions in annulus pressure as before explained.

Figure 8:
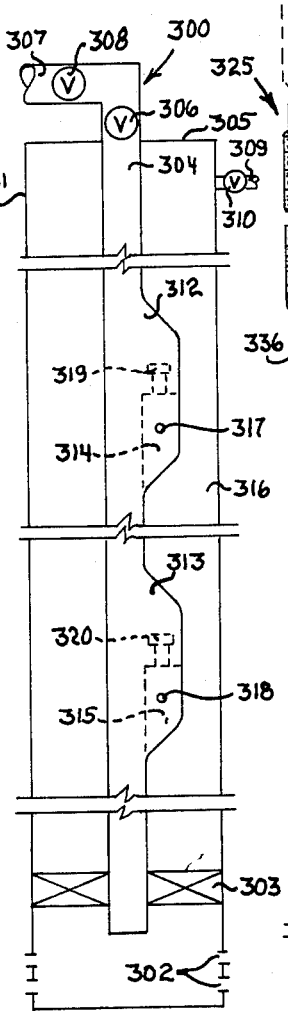
FIG. 8 is a diagrammatical view similar to FIG. 1 but showing a well with a single string of tubing which includes side pocket mandrels with gas lift valves installed therein.

Gas lift valves embodying the present invention are also useful in wells equipped with side pocket mandrels. FIG. 8 diagrammatically illustrates such a well. Well 300 is a single well completed in a conventional manner, having a casing 301, perforations 302, packer 303, tubing 304, wellhead 305, tree 306, flowline 307, wing valve 308, lift gas supply line 309, and valve 310. The tubing is equipped with a plurality of side pocket mandrels 312 and 313 having offset receptacles 314 and 315, communicating with the annulus 316 through lateral ports 317 and 318 and having gas lift valves 319 and 320, respectively, installed therein to control admission of lift gas into the tubing to aid in lifting well products to the surface, for thus producing the well. These gas lift valves are spaced in the manner before explained, and the well is unloaded and placed on production in the manner before explained.

Gas lift valves 319 and 310 may contain the same mechanism as in the valves previously described, but they must be adapted for use in side pocket mandrels.

Figure 9:
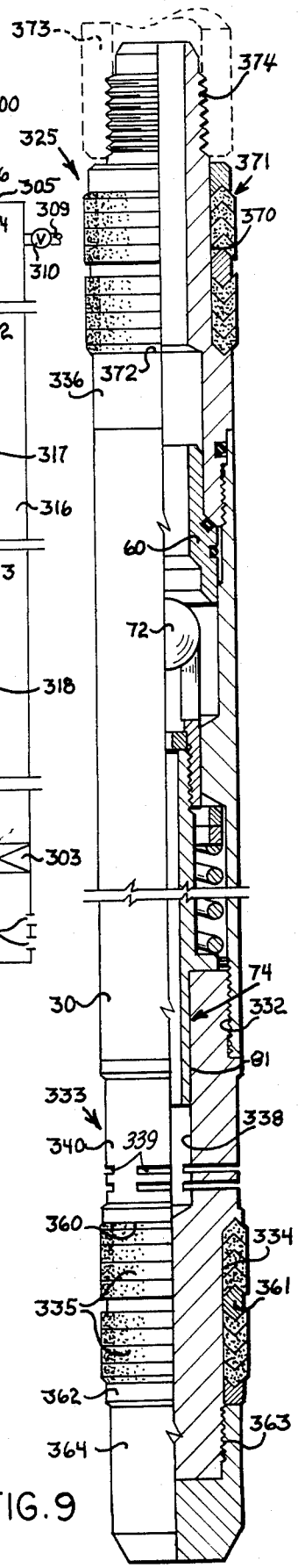
FIG. 9 is a view similar to FIG. 3 showing a gas lift valve embodying this invention and adapted for attachment to an anchoring device for retrievable installation in a landing receptacle in a well flow conductor.

FIG. 9 illustrates a valve such as valve 319 or 320. The valve in FIG. 9 is indicated generally by the reference numeral 325. The inner workings of the valve 325 are identical to those of valve 25 seen in FIGS. 2 and 3, but could be like those of valve 125 seen in FIG. 7.

Valve 325 differs from valves 25 and 125 in that its upper and lower ends are different, being adapted to carry packing rings for sealing above and below the lateral port means of side pocket mandrel receptacles such as those seen in well 300 illustrated in FIG. 8.

The plug 333 at the lower end of gas lift valve 325 is threadedly attached as at 332 to the lower end of the main body member 30 and has a blind central bore or cylinder 338 in which the piston 81 at the lower end of valve 74 is slidably received. Inlet openings for the upstream end of valve 325 are provided by the narrow filter slots or slits 339, as shown, through which lift gas enters the valve. The plug is reduced in outside diameter in the region of the slits at at 340 to provide for free passage of lift gas therearound flowing between the mandrel ports (317, 318 of FIG. 8).

Plug 333 has its lower portion reduced in diameter as at 334 to fit the bore of packing rings 335 and providing a downwardly facing shoulder 360 shaped to conform to the packing as shown to serve as a female packing adapter and save space. A double male adapter ring 361 is disposed between the upper and lower groups of packing rings 335 facing in opposite directions as shown to seal in both directions. A female packing adapter ring 362 is placed beneath the lowermost packing ring 335. The lower end of the lug is threaded as at 363 and cap 364 is attached as shown to retain the packing in place and to guide the valve as it is lowered into the well as by wireline to be removably installed in a suitable landing receptacle.

At the inner end of valve 325, its adapter 336 has its upper portion reduced in diameter as at 370 to fit the upper packing set which may be exactly like the packing set on the lower portion of the valve as just described. This upper packing set is indicated by the reference numeral 371. Reduced diameter 370 of the adapter provides an upwardly facing shoulder 372 which conforms to the upper packing as shoulder 335 conforms to the lower packing set.

The upper end of adapter 336 is threaded as at 374 for attachment to device 373 (shown in dotted lines) by which the valve 325 is anchored in place in the side pocket mandrel receptacle or in another suitable receptacle, such as a bypass landing receptacle. When the device is in place in the mandrel, its upper and lower packing sets will be disposed above and below the lateral port (317 or 318) of the mandrel to direct lift gas to inlet openings 363. Lift gas entering the mandrel through its lateral ports may flow around the valve at its external annular recess 340 in the region of the inlet openings 339 and enter therein to pass through the valve mechanism in the manner before explained on its way to the well tubing.

It should be understood that the valves illustrated and described herein could be readily modified for use in gas lift wells where well products are lifted through the tubing-casing annulus. For such use, the plug 33 at the lower end of valve device 25 would be replaced with a plug in which its central bore ran end to end and the lower end of the plug as seen in FIG. 3 would be provided with an external thread not unlike thread **36*a* seen on the upper end of adapter 36. This modified valve could then be inverted and attached to the lug 37. Since, in the inverted valve, gravity would no longer bias the valve seat 60 toward valve closure 72, it would be desirable, even necessary, to spring load the seat as taught with respect to gas lift valve 125 illustrated in FIG. 7. Also, since the thread 32 (connecting the modified plug to the housing member 30) in the inverted valve would now be subjected to a greater differential pressure (the same differential which exists across the flow bean 84), it would be desirable to seal this threaded connection with a resilient seal ring in the manner taught with respect to thread 34 at the opposite end of the housing member 30. Alternatively, the gas lift mandrel 39** could be inverted in the tubing string, in which case the gas lift valve would remain upright. In either case, the valve would control the flow of lift gas from the well tubing into the casing for lifting well products through the annulus to the surface.

Thus, it has been shown that the devices illustrated and described herein which embody the present invention fulfill all of the objects set forth at the beginning of this specification, and changes in the sizes, shapes, and arrangement of its parts may be had without departing from the true spirit of the invention.

We claim:

1. A gas lift valve for controlling flow of gas into a well flow conductor from the exterior thereof, comprising:

a. imperforate elongate tubular body means having a flow passage therethrough with inlet means at one end and outlet means at the other end and being connectable to a well flow conductor with said outlet means in communication with interior of said flow conductor and said inlet means in communication with the exterior of said flow conductor;

b. valve means in said tubular body having a seat surface thereon surrounding said flow passage;

c. valve closure means in said body having a seating surface thereon engageable with said seat surface on said valve seat means and longitudinally movable relative thereto between seated and unseated positions;

d. tubular valve stem means in said flow passage having one of its ends attached to said valve closure means and the other of its ends exposed to pressure from exterior said flow conductor, said stem means having port means in its wall adjacent said valve closure means communicating the bore of said tubular stem means with the exterior thereof, the area of the valve seat subject to pressure interior of said flow conductor being greater than the area of the valve stem subject to pressure exterior of said flow conductor; and e. means biasing said valve stem means and the valve closure means attached thereto toward unseated position.

2. The gas lift valve of claim 1 wherein said tubular valve stem means also includes flow restriction means in its bore.

3. The gas lift valve of claim 2 wherein said valve seat means in said body means comprises:

a. a seat member having a straight flow passage therethrough and a seat surface surrounding said flow passage engageable by said valve closure means;

b. coengageable shoulder means in said body and on said seat member for limiting movement of said seat member away from said valve closure means;

c. resilient seal means carried on said seat member and engageable with said shoulder means in said body means to prevent flow around said seat member when said seat member has its shoulder means engaged with said shoulder means in said body;

d. said seat member being slidable in said body means and movable into engagement with said valve closure means upon occurrence of backflow to prevent backflow of fluids through said flow passage of said body.

4. The gas lift valve of claim 3, further including:

a. said flow passage in said body means being slightly enlarged for a limited distance adjacent said shoulder means therein which is engageable by said seat means;

b. second resilient seal ring carried in an external annular recess on said seat means, said second seal ring having clearance therearound due to said enlarged passage when said seat means is shouldered in said body, said seat means being freely movable toward said valve closure until said second seal ring reaches the extent of said flow passage enlargement; and c. a longitudinally extending lip on said seat member surrounding said seat surface which, when said valve closure means is seated on said seat surface of said member, substantially restricts the annular space around said valve closure means;

d. whereby, when backflow occurs and said seat member moves toward said unseated valve closure member and its second seal ring reaches the extent of said enlargement in said flow passage, said extended lip will thereupon restrict the passage of fluids around said valve closure means and will create a differential pressure across said seat member and will force the seat member fully toward said valve closure means so that said second seal ring will move past said enlarged bore and will sealingly engage between said seat member and said housing and said valve closure will be seated on said seat member.

5. The gas lift valve of claim 4 wherein said tubular valve stem means is formed in two sections connected together by a thread and said flow restricting means is a flow bean secured in said threaded connection between opposing shoulders of said two sections of said stem means, said flow bean having a restrictive flow passage therethrough for restricting the flow of gas through said tubular valve stem means.

6. The gas lift valve of claim 5 wherein said biasing means includes:

a. internal shoulder means in said housing;

b. external shoulder means on said valve stem means; and c. a coil compression spring in said body means surrounding said stem means and supported by one and applying a bias to the other of said internal and external shoulder means tending to move said valve stem means and the valve closure means attached thereto toward unseated position.

7. The gas lift valve of claim 6 wherein said biasing means further includes means for varying the force of said spring.

8. The gas lift valve of claim 1, 2, 3, 4, 5, 6, or 7 wherein said elongate body means includes external seal rings thereon and is connectable to a locking device by which it may be removably installed in a seating nipple in a well flow conductor.

9. The gas lift valve of claim 8 wherein said one end of said body flow passage which communicates with the exterior of said flow conductor terminates at narrow slits formed in said body means to preclude the entrance thereinto of sand, debris, and the like substances.

10. The gas lift valve of claim 1, 2, 3, 4, 5, 6, or 7 wherein said one end of said body flow passage which communicates with the exterior of said flow conductor terminates at narrow slits formed in said body means to preclude the entrance thereinto of sand, debris, and the like substances.

* * * * *